United States Patent [19]

Taylor, Jr.

[11] Patent Number: 4,642,943

[45] Date of Patent: Feb. 17, 1987

[54] BELT ABRADING APPARATUS AND METHOD

[76] Inventor: Joseph R. Taylor, Jr., Rte. 2, Box 111, Richlands, N.C. 28574

[21] Appl. No.: 800,534

[22] Filed: Nov. 21, 1985

[51] Int. Cl.[4] ..... B24B 21/00

[52] U.S. Cl. ..... 51/135 R; 51/141; 51/170 ED; 51/266; 51/328; 198/811

[58] Field of Search ..... 51/135 R, 141, 148, 51/170 EB, 262 A, 266, 328, 356; 198/811

[56] References Cited

U.S. PATENT DOCUMENTS

| | | | |
|---|---|---|---|
| 401,215 | 4/1889 | Ross, Jr. | 51/356 |
| 1,036,783 | 8/1912 | Bein | 51/135 R |
| 2,055,351 | 9/1936 | Hormel | 51/135 R |
| 2,071,034 | 2/1937 | Hanna | 51/135 R |
| 2,232,149 | 2/1941 | Tautz | 51/135 R |
| 2,527,554 | 10/1950 | Kimball | 51/135 R |
| 2,530,960 | 11/1950 | Hall | 51/141 |
| 2,850,852 | 9/1958 | Hofberger | 51/135 R |
| 2,857,717 | 10/1958 | Edgemond, Jr. et al. | 51/135 R |
| 2,934,863 | 5/1960 | Pendergast | 51/141 |
| 3,448,023 | 6/1969 | Bell . | |
| 3,538,650 | 11/1970 | Pollak | 51/148 |
| 3,685,219 | 8/1972 | Palmenberg | 51/328 |
| 3,739,535 | 6/1973 | Fournier | 51/356 |
| 4,189,872 | 2/1980 | Evans | 51/135 R |

FOREIGN PATENT DOCUMENTS

| | | | |
|---|---|---|---|
| 3401462 | 8/1985 | Fed. Rep. of Germany | 51/141 |

*Primary Examiner*—Robert P. Olszewski
*Attorney, Agent, or Firm*—Richard E. Jenkins

[57] ABSTRACT

The invention comprises an apparatus and method for abrading a work piece to a desired flat surface by using a compact, high speed endless abrasive belt which travels a pathway over a drive roller and an idler roller and in which an air cushion is formed between the belt and the support table surface therebeneath during the upper run of the belt. The air cushion is created by a plurality of cavities in the idler roller which introduce an air flow between the belt and support table surface at the beginning of the upper run of the belt. The air cushion formed is maintained beneath the length of the upper run of the belt by the milled surface of the support table which serves to restrain the air flow and confine it between the belt and table surface. In this fashion a compact and high speed abrading machine is provided which requires only a relatively small horsepower motor for motivation and which obviates complex and expensive cooling systems utilized heretofore.

23 Claims, 6 Drawing Figures

BELT ABRADING APPARATUS AND METHOD

FIELD OF THE INVENTION

The invention relates to abrading machines of the type employing a traveling endless belt having an abrasive working face, a drive roller positioned within the endless belt, an idler roller positioned within the belt in spaced-apart relationship to the drive roller, and a support table provided under the upper run of the endless belt. A work piece may be abraded by placing the same against the horizontally traveling upper run of the belt in order to re-surface previously machined flat surfaces which have been distorted by heat or pitting. The work piece may typically be a warped automotive engine cylinder head or the like.

DESCRIPTION OF THE PRIOR ART

Belt sanders as heretofore constructed have suffered from numerous deficiencies in view of the heat generated by the endless belt traversing the support table during the upper horizontal run of the belt. This has resulted in a number of efforts to reduce the considerable heat generated by the belt traversing the support table therebeneath. One commercial belt abrader known to applicant utilizes a relatively high horsepower electric motor to motivate an endless belt over a smooth, chrome plated support table surface therebeneath. Additionally, in order to further reduce friction heat generated between the belt and table surface, a water spray is directed onto the belt surface. The commercial abrading unit includes a closed fluid system utilizing a reservoir to capture the water sprayed onto the belt and a water pump in fluid communication with the reservoir to pump water from the reservoir through a conduit to a spray head adjacent the endless belt of the abrading apparatus. This prior art unit suffers from several deficiencies including a high initial cost and a large space requirement. Also, a large horsepower motor, most suitably 15 to 20 horsepower, is required in order to properly operate the apparatus.

Others have also attempted to solve heat build-up problems historically associated with abrading machines. With regard thereto, U.S. Pat. No. 3,685,219 to Palmenberg discloses an air-permeable platen beneath the belt and in fluid communication with a high pressure air source. Also, U.S. Pat. No. 2,530,960 to Hall teaches providing cooling air to an abrading belt with rollers having internal passageways communicating with ambient air, and U.S. Pat. No. 1,036,783 to Bien discloses a work table possessing grooves for cooling the abrading belt passing thereover.

Although other belt sanders or abraders are known possessing a variety of structural and performance characteristics, it is not believed that any of these machines are capable of providing the abrading performance of the instant invention with a relatively compact and low cost apparatus utilizing a small horsepower motor for driving the endless belt at high speeds and with only a small amount of friction generated heat build-up during operation thereof.

SUMMARY OF THE INVENTION

The apparatus of the present invention is a compact and low cost belt abrading machine which is capable of high belt speeds without generating unacceptable and destructive friction heat between the work piece and the belt and table surface thereunder. The abrading machine of the invention comprises an endless belt having a working face of abrasive material which travels a pathway around a drive roller and a laterally spaced-apart idler roller. A support table is positioned within the belt pathway and immediately under the upper run of the belt in order to provide support when a work piece is abraded by the instant invention. The peripheral surface of the idler roller defines a plurality of surface cavities therein in order to introduce an air cushion under the endless belt and above the support table surface at the beginning of the upper run of the belt, and the support table has a milled surface so as to tend to capture and maintain the air cushion along the entire upper run of the belt. In this manner, high operating speeds at low friction temperatures can be achieved by the instant invention with a relatively compact construction utilizing a small horsepower drive motor.

It is therefore an object of the present invention to provide a belt abrading machine of high performance capabilities and of simplified construction.

Another object of the present invention is to provide a belt abrading machine which utilizes an air cushion between the endless belt and work table surface therebelow in order to facilitate high operating speeds at low friction temperatures.

Still another object of the present invention is to provide a high performance belt abrading machine of compact size and requiring only a small drive motor in view of an air cushion created between the endless belt and the support table surface therebeneath.

A still more specific object of the instant invention is to provide a compact and high speed belt abrading apparatus which utilizes a plurality of cavities in the idler roller to introduce an air cushion between the belt and the work table, and a milled work table surface to maintain the air cushion along the length of the upper run of the endless belt.

BRIEF DESCRIPTION OF THE DRAWINGS

The above and other features of the invention will now be described in detail with reference to the accompanying drawings in which.

DESCRIPTION OF THE PREFERRED EMBODIMENT

Briefly stated, the invention contemplates an improved endless belt abrading machine in which cavities are provided within the idler roller thereof in order to introduce an air cushion between the belt and the support table therebeneath at the beginning of the upper run of the belt, and the surface of the support table is milled so as to maintain the air cushion along the length of the upper run of the endless belt. In this manner a compact and high speed abrading machine is provided.

Figure 1:
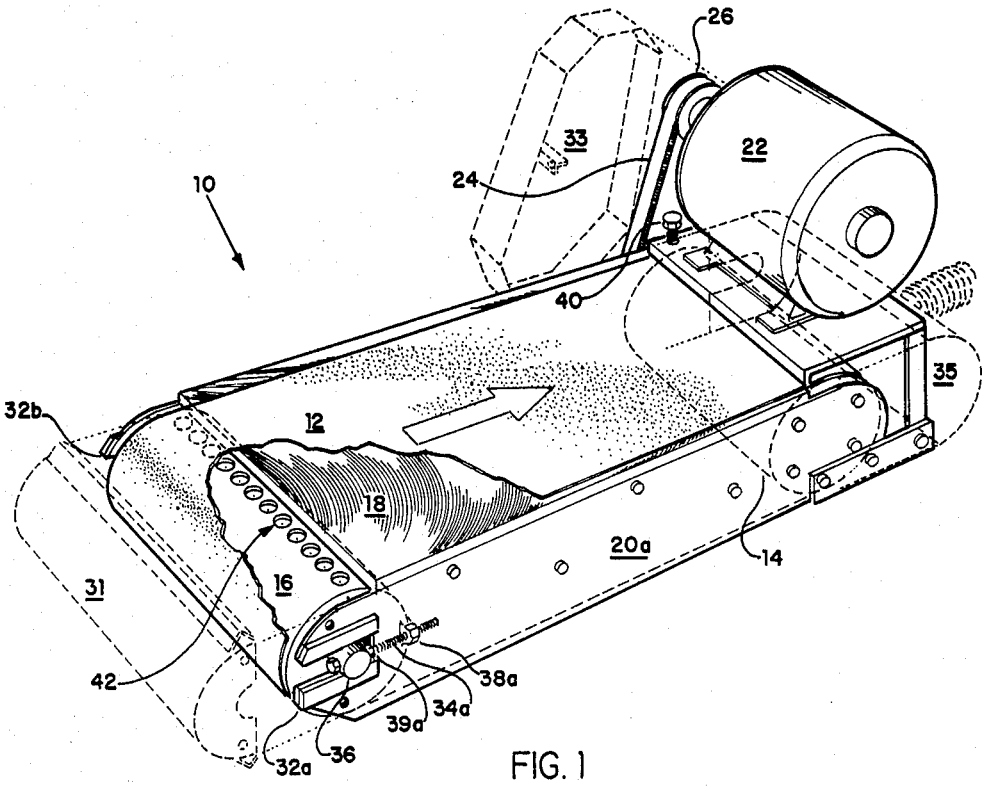
FIG. 1 is a perspective view of the abrading machine with certain optional parts broken away and the abrading belt cut away so as to show the idler roller and support table surface with greater clarity.

Referring now to the drawings, the improved abrading machine of the instant invention, generally designated 10, may initially best be understood with reference to FIG. 1 of the drawings. It will be recalled that the function of the improved abrading machine is to re-surface previously machined flat surfaces which have been distorted by heat or pitting such as automotive engine cylinder heads and blocks. After the work piece has been properly abraded or ground on the abrading machine it may be again utilized in the original automotive engine and thereby results in considerable cost savings by obviating the need for replacement of the damaged engine with an entirely new engine.

Abrading machine 10 utilizes an endless belt 12 which travels a pathway around drive roller 14 and idler roller 16. Belt 12 is typically of fiberglass construction with a grit working surface and, in the preferred embodiment of the invention, is approximately 14 inches wide and 86 inches long. The upper run of belt 12 is supported by a milled flat plate 18 which is bolted to side rails 20*a*, 20*b*. In the preferred embodiment, side rails 20*a*, 20*b* are approximately 6 inches in height and plate 18 is approximately 15 inches wide and 30 inches long so as to be substantially coextensive with the upper run of belt 12. Rail 20*a* is most suitably 39 inches long whereas rail 20*b* is 46½ inches long (see FIG. 2) in order to provide a support base for motor 22 to be fixedly secured to.

Side rails 20*a*, 20*b* are spaced apart and adapted to rotatably support drive roller 14 and idler roller 16 in parallel relationship approximately 35 inches apart. Motor 22 is most suitably an electric single phase 7½ horsepower DAYTON motor which is operatively connected to drive roller 14 by a V-grooved rubber belt 24 which extends around motor pulley 26 and drive roller pulley 28. Motor pulley 26 and drive roller pulley 28 are most suitably of 3 inch and 5 inch diameters, respectively. A mounting platform 30 for motor 22 is secured to rails 20*a*, 20*b* above drive roller 14 and further serves as a stop bar in order to hold the work piece in position over plate 18 as belt 12 travels beneath it and in abrading contact. In this fashion a work piece having a warped flat surface may be ground or abraded and restored to its original use. Also shown in FIG. 1 are optional idler roller cover 31 and V-belt cover 33 which may be utilized as safety enhancements. Vacuum shroud 35 connected by hose to a remote vacuum means may also optionally be adapted to the abrader to remove sand, steel and other particles to a remote location.

Figure 2:
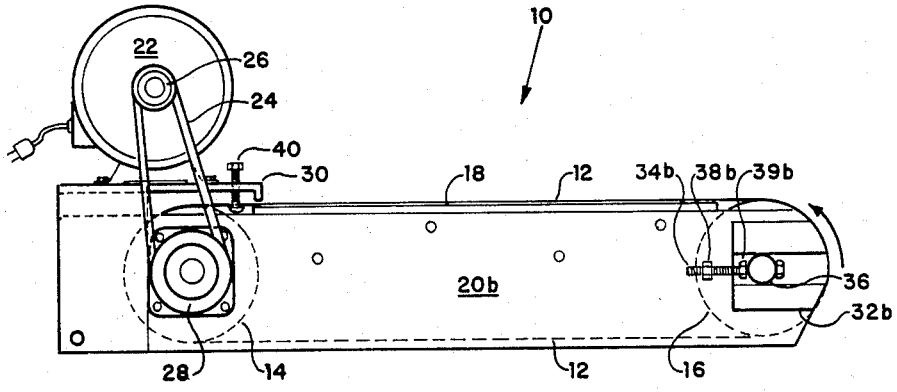
FIG. 2 is a side elevation of the abrading machine.
Figure 4:
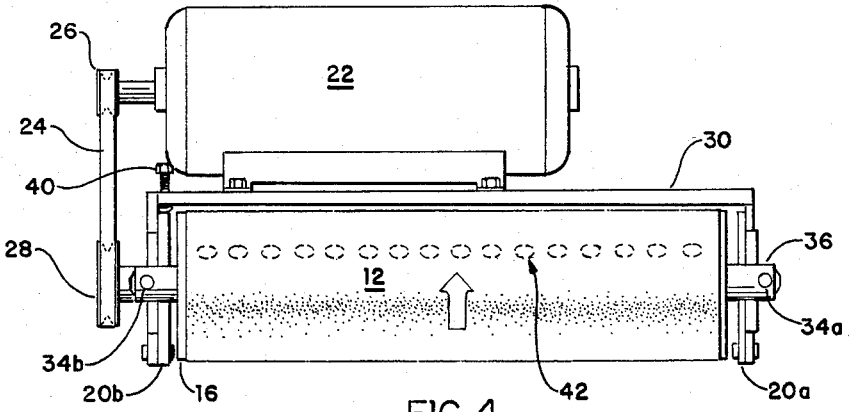
FIG. 4 is an front elevation of the abrading machine.
Figure 5:
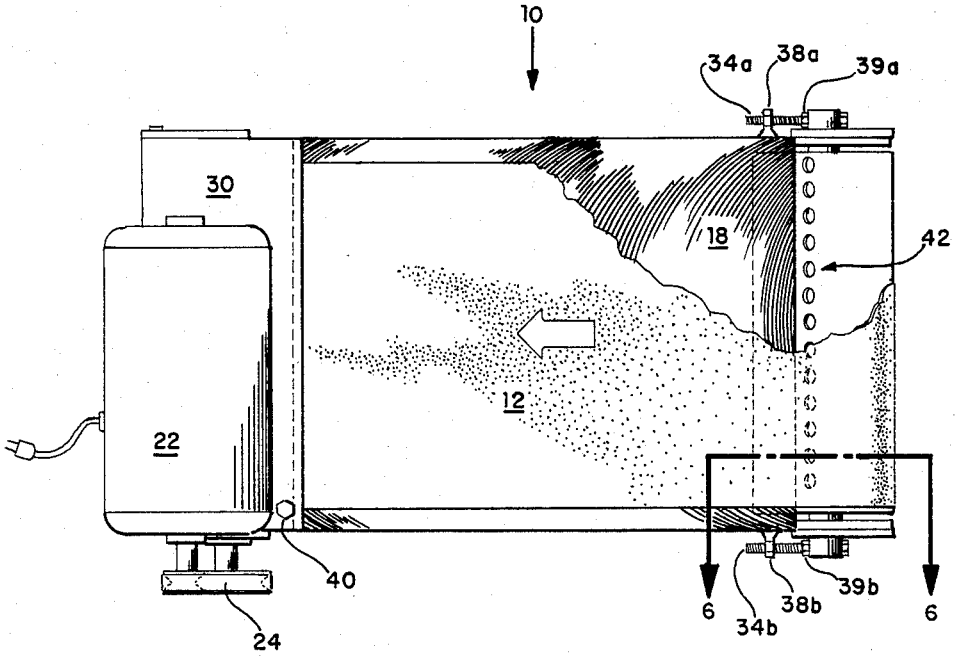
FIG. 5 is a top plan view of the abrading machine with the abrading belt being cut away for clarity of understanding.

With particular reference to FIGS. 1, 2 and 5, it should be appreciated that idler roller 16 may be slidably moved within slots 32*a*, 32*b* of side rails 20*a*, 20*b*, respectively. The slidable adjustment is desirable in order to properly tension belt 12 about drive roller 14 and idler roller 16 for most efficient abrading performance against a work piece. Threaded bolts 34*a*, 34*b* are inserted through apertures at each end of idler roller shaft 36 (see also FIG. 4). Bolts 34*a*, 34*b* are then each threadingly secured to a corresponding nut 38*a*, 38*b* which has been welded to its respective side rail 20*a*, 20*b*. Bolts 34*a*, 34*b* are locked into position with lock nuts 39*a*, 39*b*. In this fashion idler roller 16 may be slidably adjusted by moving it toward or away from motor 22 and securing it in the new position in order to provide the proper tension to belt 12. Nuts 38*a*, 38*b* and lock nuts 39*a*, 39*b* secure idler roller 16 in the selected position.

Most suitably, drive roller 14 and idler roller 16 are 14 inches in length and include a 1¼ inch shaft at each end thereof which is rotatably positioned within a sealed roller bearing. Motor platform 30 is vertically adjusted by threaded bolt 40 near the stop bar which is screwed in or out against side rail 20*b*. In this fashion belt 24 may be properly tensioned between drive roller pulley 26 and idler roller pulley 28.

Figure 6:
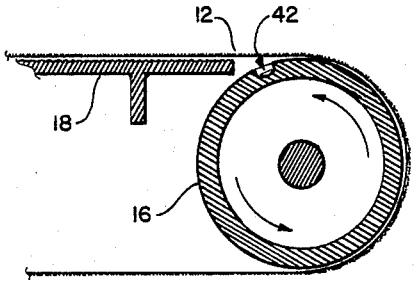
FIG. 6 is a vertical cross-sectional view taken generally along the line 6—6 of FIG. 5.

Now that the conventional structure of the instant invention is understood and appreciated, reference should be had particularly to FIGS. 1, 5 and 6 of the drawings which will aid in a full understanding of the novel features of abrading machine 10. Specifically, idler roller 16 has a row of holes, generally designated 42, located in the surface thereof but not extending therethrough. Holes 42 are preferably about 1/16 to ⅛ inch deep and have a diameter of 0.500 inches and serve to create an air cushion between belt 12 and support surface 18 at the beginning of the upper run of endless belt 12 toward motor 22. The air cushion, as best understood with reference to FIG. 6, is formed between belt 12 and support table surface 18 by the high speed rotation of idler roller 16 which drives belt 12 at a linear speed of approximately 6,000 to 7,000 feet per minute. Furthermore, the air cushion is facilitated down the entire length of the upper run of belt 12 by the lands and grooves within the top surface of support table 18. The lands and grooves are formed in the surface of support table 18, which is preferably constructed of iron, by conventional milling and result in a substantial capturing and retaining of the air cushion between support table 18 and belt 12. The grooves are most suitably about 0.008–0.012 inch deep. Without the lands and grooves formed in the surface of support table 18 it has been discovered that the air cushion introduced by holes 42 will promptly dissipate and will not be sustained along the entire length of the upper run of belt 12. The aforementioned air cushion serves to prevent the generation of unacceptable levels of friction temperature which can be detrimental to the durability and functioning of an abrading machine. Furthermore, the air cushion substantially reduces friction between belt 12 and the surface of work table 18 so as to allow for high speed operation of the instant machine with a relatively small 7.5 horsepower motor 22.

Figure 3:
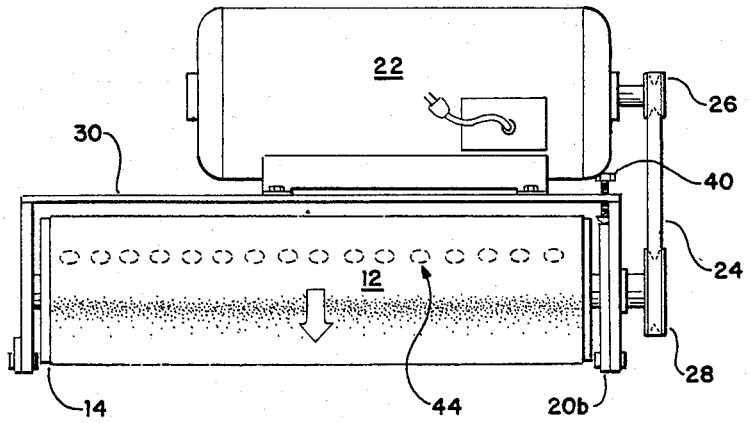
FIG. 3 is a rear elevation view of the abrading machine.

Although it is not a requirement of the instant invention, a row of holes, generally designated 44, may also be provided in drive roller 14 (see FIG. 3) in order to create an air flow at the juncture of drive roller 14 and belt 12 which serves to create a cleansing air current and thereby carry away dirt, sand and other foreign particles which may otherwise accumulate between belt 12 and work table 18.

In operation, a work piece is forced against belt 12 of abrading apparatus 10 in order to abrade or grind down a warped surface thereof. As noted above, the stop bar of motor platform 30 serves to hold the work piece in place on support table 18 as belt 12 is abradingly driven beneath it. Idler roller 16 and V-belt 24 may each be adjusted as necessary in order to assure proper tension on abrading belt 12 and V-belt 24, respectively. An air cushion is formed between belt 12 and work table 18 along length of the upper run of belt 12 by holes 42 in idler roller 16 which serve to pump air into the space between belt 12 and table surface 18 at the beginning of the upper run of the belt. The air cushion formed at the beginning of the upper run of belt 12 is maintained throughout the length of the upper run by lands and grooves which have been milled into the surface of support table 18 and tend to capture the air cushion whereas a smooth support table surface would allow it to quickly dissipate and unacceptable friction temperature to develop between belt 12 and support table 18. The abrading machine of the instant invention possesses performance characteristics and a compactness of construction which are not believed to be known in this art. It has been found that a automotive engine head with a 0.005–0.010 inch warp can be milled to a true surface in about 45 seconds with the improved machine. Also, by way of further illustration, an engine block with a 0.038 inch warp may be precisely milled to a true surface and examined in less than three minutes time.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and methods.

What is claimed is:

1. In an abrading machine comprising an endless belt having a working face of abrasive material, a drive roller positioned within said endless belt, an idler roller positioned within said belt in spaced-apart relationship to said drive roller, and a support table positioned under the upper run of said endless belt, the improvement wherein said idler roller defines a plurality of surface cavities therein for introducing an air cushion between said belt and said table at the beginning of the upper run of said belt, and said table surface comprises a plurality of lands and grooves for maintaining said air cushion under the upper run of said belt.

2. An abrading machine as described in claim 1 wherein said plurality of cavities defined by said idler roller comprises a row of holes across said roller.

3. An abrading machine as described in claim 2 wherein said holes are about 1/16 to ⅛ inch deep.

4. An abrading machine as described in claim 1 wherein said drive roller defines a plurality of surface cavities therein.

5. An abrading machine as described in claim 1 wherein said table is iron and the surface thereof has been milled so as to create said lands and grooves therein.

6. An abrading machine as described in claim 5 wherein said lands and grooves extend substantially perpendicularly to the direction of travel of said belt thereon.

7. An abrading machine as described in claim 1 including an electric motor operatively associated with said drive roller.

8. An abrading machine as described in claim 7 wherein said electric motor is a single phase 7.5 horsepower motor.

9. In an abrading machine comprising an endless belt having a working face of abrasive material, a drive roller positioned within said endless belt, an idler roller positioned within said belt in spaced-apart relationship to said drive roller, and a support table positioned under the upper run of said endless belt, the improvement wherein said idler roller defines a row of surface cavities thereacross for introducing an air cushion between said belt and said table adjacent the beginning of the upper run of said belt, and said support table comprises a milled surface defining lands and grooves for maintaining said air cushion under the upper run of said belt.

10. An abrading machine as described in claim 9 wherein said cavities are about 1/16 to ⅛ inch deep.

11. An abrading machine as described in claim 9 wherein said lands and grooves extend substantially perpendicularly to the direction of travel of said belt thereon.

12. An abrading machine as described in claim 9 including an electric motor operatively associated with said drive roller.

13. A method of abrading a work surface comprising the steps of driving an endless belt along a predetermined path of movement around a drive roller and spaced-apart idler roller, providing a work table positioned between said rollers and beneath the upper run of said belt, introducing an air cushion between said work table and said belt with said idler roller, said air cushion being effected by a plurality of surface cavities provided in said idler roller to introduce an air flow between said belt and said table adjacent the beginning of the upper run of said belt, and maintaining the air cushion between said belt and said table with a plurality of lands and grooves provided in the surface of said table.

14. A method of abrading as described in claim 13 wherein said surface cavities are holes arranged in a row across the idler roller which extend about 1/16 to ⅛ inch into the roller surface.

15. A method of abrading as described in claim 13 wherein said lands and grooves extend substantially perpendicularly to the direction of travel of said belt.

16. A method of abrading as described in claim 13 wherein said belt is driven by an electric motor operatively associated with said drive roller.

17. In an abrading machine comprising an endless belt having a working face of abrasive material, a drive roller positioned within said endless belt, an idler roller positioned within said belt in spaced-apart relationship to said drive roller, and a support table positioned under the upper run of said endless belt, the improvement wherein said idler roller defines a plurality of surface cavities therein for introducing an air cushion between said belt and said table adjacent the beginning of the upper run of said belt, and said support table comprises a rough surface for maintaining said air cushion under the upper run of said belt.

18. An abrading machine as described in claim 17 wherein said plurality of cavities defined by said idler roller comprises a horizontal row of holes across said roller, said holes not extending through said roller.

19. An abrading machine as described in claim 18 wherein said holes are about 1/16 to ⅛ inch deep.

20. An abrading machine as described in claim 17 wherein said rough surface comprises lands and grooves which extend substantially perpendicularly to the direction of travel of said belt thereon.

21. An abrading machine as described in claim 17 wherein said drive roller defines a plurality of surface cavities therein.

22. An abrading machine as described in claim 17 including an electric motor operatively associated with said drive roller.

23. An abrading machine as described in claim 22 wherein said electric motor is a single phase 7.5 horsepower motor.

* * * * *